US011030882B2

(12) United States Patent
Peterson et al.

(10) Patent No.: US 11,030,882 B2
(45) Date of Patent: Jun. 8, 2021

(54) AUTOMATED SECURITY SUBSYSTEM ACTIVATION

(71) Applicant: LENOVO (Singapore) PTE. LTD., New Tech Park (SG)

(72) Inventors: Nathan J. Peterson, Oxford, NC (US); Russell Speight VanBlon, Raleigh, NC (US); John Carl Mese, Cary, NC (US); Mark Patrick Delaney, Raleigh, NC (US)

(73) Assignee: Lenovo (Singapore) PTE. LTD., New Tech Park (SG)

( * ) Notice: Subject to any disclaimer, the term of this patent is extended or adjusted under 35 U.S.C. 154(b) by 0 days.

(21) Appl. No.: 16/298,949

(22) Filed: Mar. 11, 2019

(65) Prior Publication Data

US 2020/0294386 A1 Sep. 17, 2020

(51) Int. Cl.
*G08B 25/00* (2006.01)
*G08B 21/22* (2006.01)

(52) U.S. Cl.
CPC ..... *G08B 25/008* (2013.01); *G08B 21/22* (2013.01)

(58) Field of Classification Search
CPC .. G08B 29/186; G08B 19/005; G08B 25/008; G08B 21/22; G08B 31/00
See application file for complete search history.

(56) References Cited

U.S. PATENT DOCUMENTS 5,486,812 A * 1/1996 Todd ..... G08B 25/10 340/10.1
6,225,903 B1 * 5/2001 Soloway ..... E05B 45/12 307/10.5
9,911,318 B2 * 3/2018 Boettcher ..... C12N 15/85
10,393,589 B2 * 8/2019 Fadell ..... G01J 5/025
10,645,772 B2 * 5/2020 Child ..... H05B 47/105
2004/0030531 A1 * 2/2004 Miller ..... A61B 5/0002 702/182
2006/0033625 A1 * 2/2006 Johnson ..... G06Q 10/10 340/573.1
2010/0283579 A1 * 11/2010 Kraus ..... G07C 9/00944 340/5.7
2014/0167929 A1 * 6/2014 Shim ..... G08C 17/02 340/12.5
2014/0280865 A1 * 9/2014 Albertson ..... H04L 43/10 709/224
2015/0116111 A1 * 4/2015 Foster ..... G07C 9/00071 340/517
2015/0308706 A1 * 10/2015 Bunker ..... F24D 19/1096 700/275
2015/0309487 A1 * 10/2015 Lyman ..... H04L 12/2803 700/275
2016/0100233 A1 * 4/2016 Fadell ..... G05B 15/02 340/870.02
2016/0121479 A1 * 5/2016 Lin ..... B25J 9/0003 700/264
2016/0189527 A1 * 6/2016 Peterson ..... G08B 25/008 340/541

(Continued)

*Primary Examiner* — Hai Phan
*Assistant Examiner* — Son M Tang
(74) *Attorney, Agent, or Firm* — Kunzler Bean & Adamson

(57) ABSTRACT

For automated security subsystem activation, a processor monitors occupant activity from a plurality of electronic devices. The processor further determines the occupant activity satisfies a quiescence model. The processor activates the security subsystem in response to satisfying the quiescence model.

14 Claims, 11 Drawing Sheets

(56) References Cited

U.S. PATENT DOCUMENTS

| | | | | |
|---|---|---|---|---|
| 2016/0234034 | A1* | 8/2016 | Mahar | H04L 12/282 |
| 2017/0030737 | A1* | 2/2017 | Elie | B60J 5/047 |
| 2017/0245344 | A1* | 8/2017 | Child | H05B 47/105 |
| 2017/0292893 | A1* | 10/2017 | Bunker | G01M 3/26 |
| 2018/0120779 | A1* | 5/2018 | Billings | G05B 13/024 |
| 2018/0120782 | A1* | 5/2018 | Billings | G05B 15/02 |
| 2018/0252589 | A1* | 9/2018 | Fadell | H04L 12/282 |
| 2018/0325270 | A1* | 11/2018 | Purser | G01D 3/032 |
| 2019/0087696 | A1* | 3/2019 | Verhoeven | G08B 29/183 |
| 2019/0309974 | A1* | 10/2019 | Kostrun | F24F 11/46 |
| 2019/0310589 | A1* | 10/2019 | Gervais | G06K 9/2018 |

* cited by examiner

AUTOMATED SECURITY SUBSYSTEM ACTIVATION

FIELD

The subject matter disclosed herein relates to security subsystem activation and more particularly relates to automated security subsystem activation.

BACKGROUND

A user may forget to activate a security subsystem.

BRIEF SUMMARY

An apparatus for automated security subsystem activation is disclosed. The apparatus includes a security subsystem, a processor, and a memory. The memory stores code executable by the processor. The processor monitors occupant activity from a plurality of electronic devices. The processor further determines the occupant activity satisfies a quiescence model. The processor activates the security subsystem in response to satisfying the quiescence model. A method and program product also perform the functions of the apparatus.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1A:
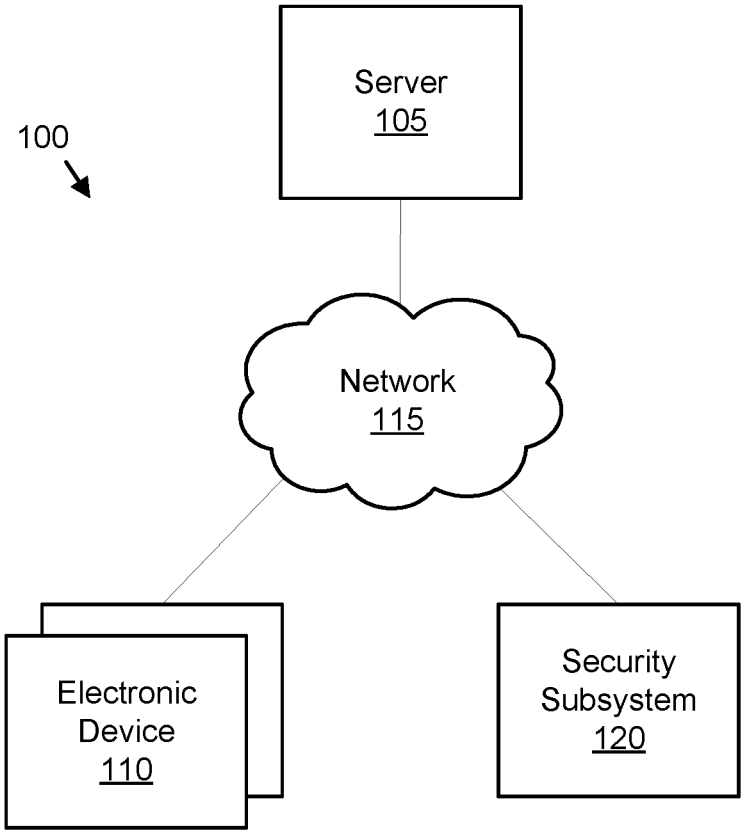
FIG. 1A is a schematic block diagram illustrating one embodiment of a activation system.

As will be appreciated by one skilled in the art, aspects of the embodiments may be embodied as a system, method or program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments may take the form of a program product embodied in one or more computer readable storage devices storing machine readable code, computer readable code, and/or program code, referred hereafter as code. The storage devices may be tangible, non-transitory, and/or non-transmission. The storage devices may not embody signals. In a certain embodiment, the storage devices only employ signals for accessing code.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in code and/or software for execution by various types of processors. An identified module of code may, for instance, comprise one or more physical or logical blocks of executable code which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different computer readable storage devices. Where a module or portions of a module are implemented in software, the software portions are stored on one or more computer readable storage devices.

Any combination of one or more computer readable medium may be utilized. The computer readable medium may be a computer readable storage medium. The computer readable storage medium may be a storage device storing the code. The storage device may be, for example, but not limited to, an electronic, magnetic, optical, electromagnetic, infrared, holographic, micromechanical, or semiconductor system, apparatus, or device, or any suitable combination of the foregoing.

More specific examples (a non-exhaustive list) of the storage device would include the following: an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Code for carrying out operations for embodiments may be written in any combination of one or more programming languages including an object oriented programming language such as Python, Ruby, Java, Smalltalk, C++, or the like, and conventional procedural programming languages, such as the "C" programming language, or the like, and/or machine languages such as assembly languages. The code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to," unless expressly specified otherwise. An enumerated listing of items does not imply that any or all of the items are mutually exclusive, unless expressly specified otherwise. The terms "a," "an," and "the" also refer to "one or more" unless expressly specified otherwise.

Furthermore, the described features, structures, or characteristics of the embodiments may be combined in any suitable manner. In the following description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and program products according to embodiments. It will be understood that each block of the schematic flowchart diagrams and/or schematic block diagrams, and combinations of blocks in the schematic flowchart diagrams and/or schematic block diagrams, can be implemented by code. This code may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

The code may also be stored in a storage device that can direct a computer, other programmable data processing apparatus, or other devices to function in a particular manner, such that the instructions stored in the storage device produce an article of manufacture including instructions which implement the function/act specified in the schematic flowchart diagrams and/or schematic block diagrams block or blocks.

The code may also be loaded onto a computer, other programmable data processing apparatus, or other devices to cause a series of operational steps to be performed on the computer, other programmable apparatus or other devices to produce a computer implemented process such that the code which execute on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods and program products according to various embodiments. In this regard, each block in the schematic flowchart diagrams and/or schematic block diagrams may represent a module, segment, or portion of code, which comprises one or more executable instructions of the code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and code.

The description of elements in each figure may refer to elements of proceeding figures. Like numbers refer to like elements in all figures, including alternate embodiments of like elements.

FIG. 1A is a schematic block diagram illustrating one embodiment of a activation system 100. The activation system 100 may automatically activate and deactivate a security subsystem 120. The security subsystem 120 may protect a space such as a dwelling, office, business, and the like from intrusion. The security subsystem 120 may include motion detectors, opening detectors, and the like for detecting the unwanted intrusion.

Unfortunately, the security subsystem 120 can only protect the space if the security subsystem 120 is activated. In addition, if the security subsystem 120 is activated when occupants of the space wish to exit, the security subsystem 120 may generate a false alarm, inconveniencing the occupants. The embodiments automatically activate the security subsystem 120.

In the depicted embodiment, the activation system 100 includes a server 105, a network 115, the security subsystem 120, and one or more electronic devices 110. The network 115 may be the Internet, a local area network, a wide-area network, a Wi-Fi network, a mobile telephone network, or combinations thereof. The server 105, electronic device 110, and security subsystem 120, may communicate through the network 115. The activation system 100 may monitor occupant activity from a plurality electronic devices 110. The activation system 100 may further determine if the occupant activity satisfies a quiescence model. In addition, the activation system may activate the security subsystem 120 in response to satisfying a quiescence model as will be described hereafter.

In the depicted embodiment, the server 105 may monitor the occupant activity from the plurality of electronic devices 110, determine the occupant activity satisfies the quiescence model, and activate the security subsystem 120.

Figure 1B:
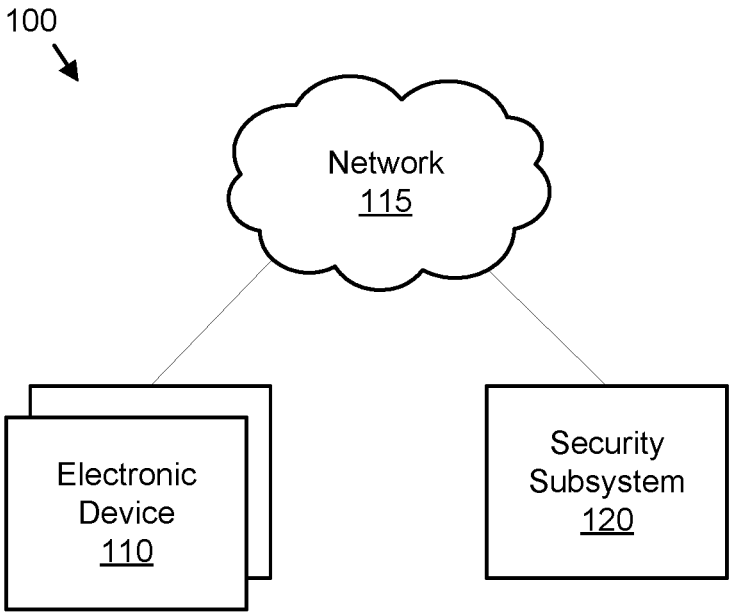
FIG. 1B is a schematic block diagram illustrating one alternate embodiment of a activation system.

FIG. 1B is a schematic block diagram illustrating one embodiment of a activation system 100. In the depicted embodiment, the activation system 100 includes the network 115, the plurality of electronic devices 110, and the security subsystem 120. In one embodiment, the security subsystem 120 monitors the occupant activity from the plurality of electronic devices 110. In addition, the security subsystem 120 may determine that the occupant activity satisfies the quiescence model and activate itself.

In an alternative embodiment, one or more electronic devices 110 may monitor the occupant activity from the plurality of electronic devices 110. The one or more electronic devices 110 may determine that the occupant activity satisfies the quiescence model and activate the security subsystem 120.

Figure 1C:
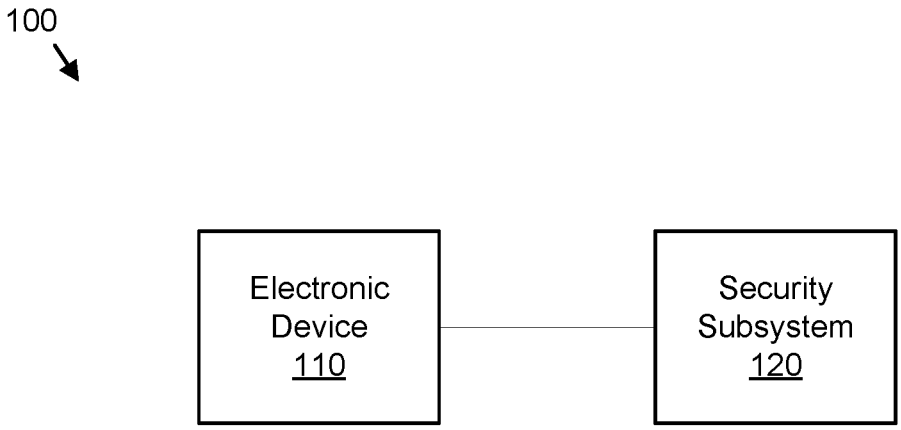
FIG. 1C is a schematic block diagram illustrating one alternate embodiment of a activation system.

FIG. 1C is a schematic block diagram illustrating one embodiment of a activation system 100. In the depicted embodiment, one or more electronic devices 110 communicate directly with the security subsystem 120 through a connection such as an infrared connection and/or a Bluetooth connection. The security subsystem 120 may monitor the occupant activity from the plurality of electronic devices 110, determine that the occupant activity satisfies the quiescence model, and activate itself. Alternatively, the one or more electronic devices 110 may determine that the occupant activity satisfies the quiescence model and activate the security subsystem 120.

Figure 2:
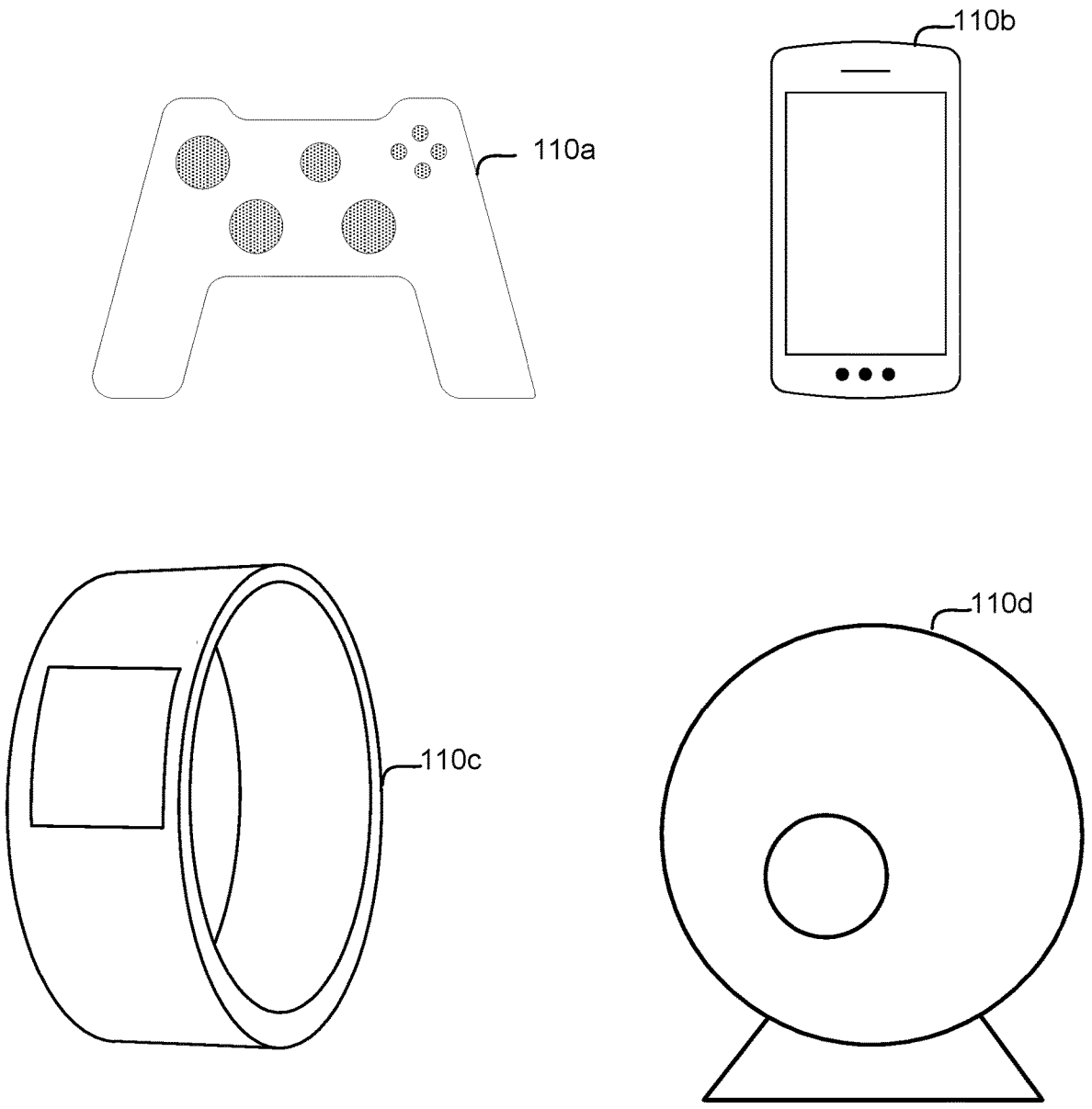
FIG. 2 is drawings illustrating embodiments of electronic devices.

FIG. 2 is drawings illustrating embodiments of electronic devices 100. In the depicted embodiment, the electronic devices 110 include a controller 110*a*, a mobile telephone 110*b*, a wearable electronic device 110*c*, and a camera 110*d*. Other electronic devices 110 may also be employed.

Figure 3:
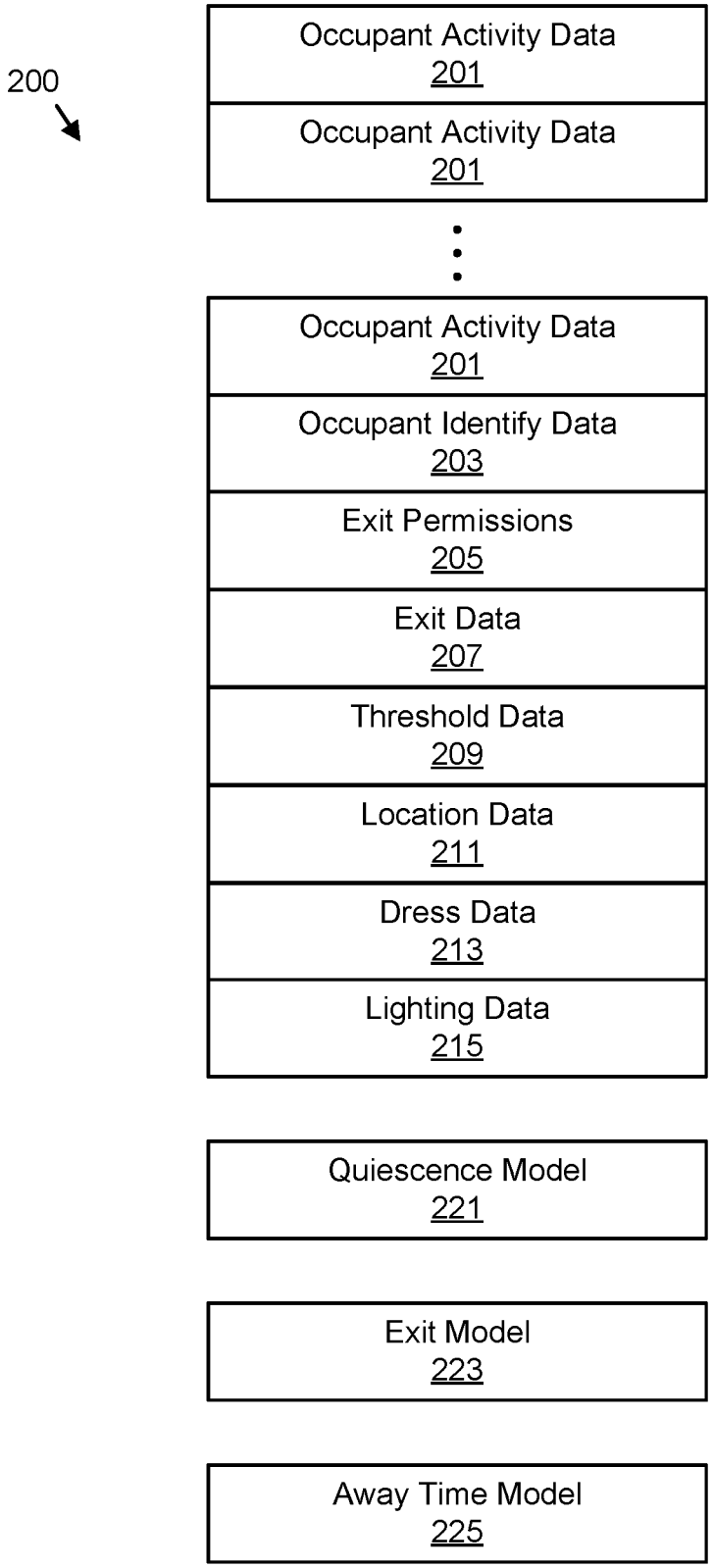
FIG. 3 is a schematic block diagram illustrating one embodiment of security data.

FIG. 3 is a schematic block diagram illustrating one embodiment of security data 200. The security data 200 maybe organized as a data structure in a memory. In the depicted embodiment, the security data 200 includes occupant activity data 201, occupant identity data 203, exit permissions 205, exit data 207, threshold data 209, location data 211, dress data 213, and lighting data 215. In addition, the security data 200 may include the quiescence model 221, an exit model 223, and an away time model 225.

The occupant activity data 201 may record occupant activity from the electronic devices 110. The occupant activity may include but is not limited to direct occupant interaction with the electronic device 110, motions of the electronic device 110, images of the occupant captured by the electronic device 110, sounds of the occupant captured by the electronic device 110, and/or a charging status of the electronic device 110.

The occupant identity data 203 may record biometric data for identifying one or more occupants. The biometric data may include images of the occupants, voice prints of the occupants, fingerprints of the occupants, calendars of the occupants, historical schedules of the occupants, and the like.

The exit permissions 205 may record which occupants are allowed to exit the space during which times. In addition, the exit permissions 205 may specify conditions for exiting the space. For example, an adult occupant may have exit permission at any time, while a teenage occupant may have exit permission from 6:00 to 22:00 and a child occupant may only have exit permission when accompanied by an adult.

The exit data 207 may record historical exits of occupants from the space. The threshold data 209 may record one or more thresholds for determining when the quiescence model 221, the exit model 223, and/or the away time model 225 are satisfied.

The location data 211 may record a location of each occupant. The locations may be determined from the occupant activity data 201. For example, Global Positioning System (GPS) coordinates from the mobile telephone electronic device 110*b* of an occupant may be used to determine the occupants location. In addition, an image from the camera electronic device 110*d* may be matched to the occupant identity data 203 to determine a location of the occupant.

The dress data 213 may record the clothing worn by an occupant when the occupant exits the space. The dress data 213 may be used to determine whether the occupant is dressed to exit the space. The lighting data 215 may record the lighting of the space at a specified time each day such as 3:00 AM. The lighting data 215 may be used to determine if the lighting of the space satisfies a quiescence level.

The quiescence model 221, exit model 223, and/or away time model 225 maybe organized as neural networks as will be described hereafter. In addition, the quiescence model 221, exit model 223, and away time model 225 may comprise one or more algorithms.

Figure 4A:
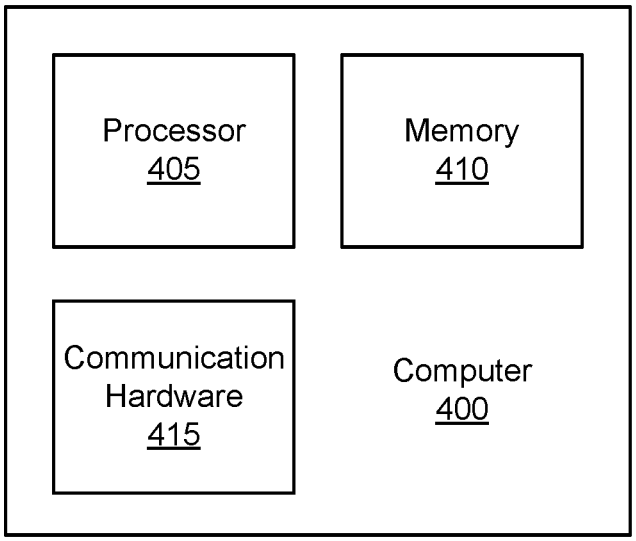
FIG. 4A is a schematic block diagram illustrating one embodiment of a computer.

FIG. 4A is a schematic block diagram illustrating one embodiment of a computer 400. The computer 400 may be embodied in one or more of the server 105, an electronic device 110, and/or the security subsystem 120. In the depicted embodiment, the computer 400 includes a processor 405, a memory 410, and communication hardware 415. The memory 410 may include a semiconductor storage device, hard disk drive, an optical storage device, a micromechanical storage device, or combinations thereof. The memory 410 may store code. The processor 405 may execute the code. The communication hardware 415 may communicate with other devices such as the network 115.

Figure 4B:
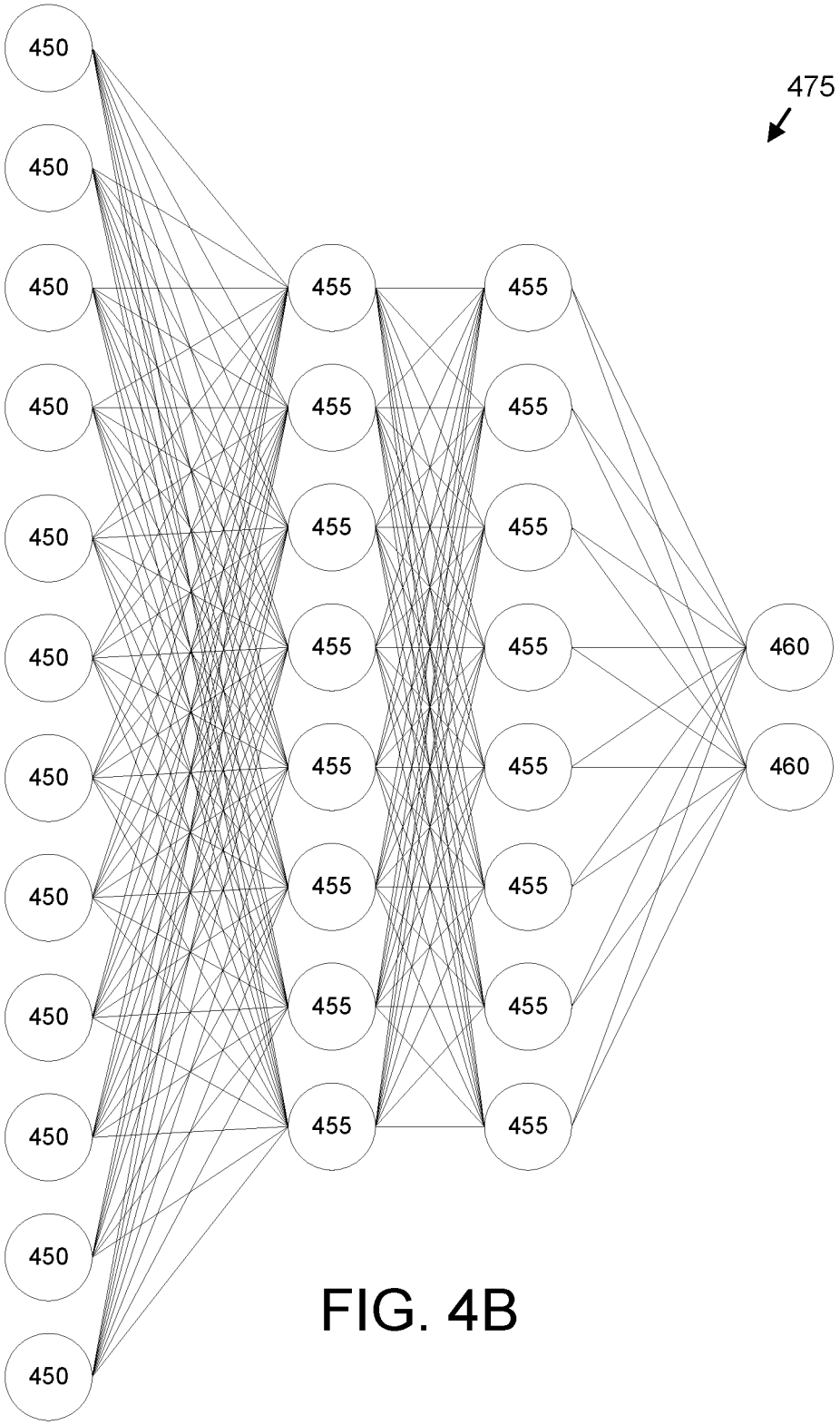
FIG. 4B is a schematic diagram illustrating one embodiment of a neural network.

FIG. 4B is a schematic block diagram illustrating one embodiment of a neural network 475. In the depicted embodiment, the neural network 475 includes input neurons 450, hidden neurons 455, and output neurons 460. The neural network 475 may be organized as a convolutional neural network, a recurrent neural network, and the like.

The neural network 475 may be trained with training data. The training data may include occupant activity data 201, exit data 207, and/or location data 211. The neural network 475 may be trained using one or more learning functions while applying the training data to the input neurons 450 and known result values for the output neurons 460. Subsequently, the neural network 465 may receive actual data at the input neurons 450 and make predictions at the output neurons 460 based on the actual data. The actual data may include data from the occupant activity data 201, exit data 207, and/or location data 211.

In one embodiment, the quiescence model 221 is the neural network 475 recursively trained from a plurality of occupant activity data 201 and the exit data 207, location data 211, dress data 213, and/or lighting data 215. In a certain embodiment, the quiescence model 221 is the neural network 475 recursively trained from the plurality of occupant activity data 201 and a last exit of the exit data 207. The last exit may be the last instance of an occupant exiting the space before a specified time such as 5:00 AM. For example, the quiescence model 221 may be satisfied when historical conditions of the exit data 207, the location data 211, the dress data 213, and the lighting data 215 are satisfied after a last exit of the day.

In one embodiment, the exit model 223 is the neural network 475 recursively trained from the plurality of occupant activity data 201 and the exit data 207, the location data 211, the dress data 213, and/or the lighting data 215. For example, the exit model 223 may be satisfied when historical conditions of the exit data 207 are replicated. In addition, the exit model 223 may be satisfied when historical conditions of the exit data 207, location data 211, dress data 213, and lighting data 215 are satisfied.

In one embodiment, the away time model 225 is the neural network 475 recursively trained from the plurality of occupant activity data 201 and the exit data 207, the location data 211, and the dress data 213. The away time model 215 may forecast an away time. The away time may forecast a time interval before any occupant returns to the space.

Figure 5A:
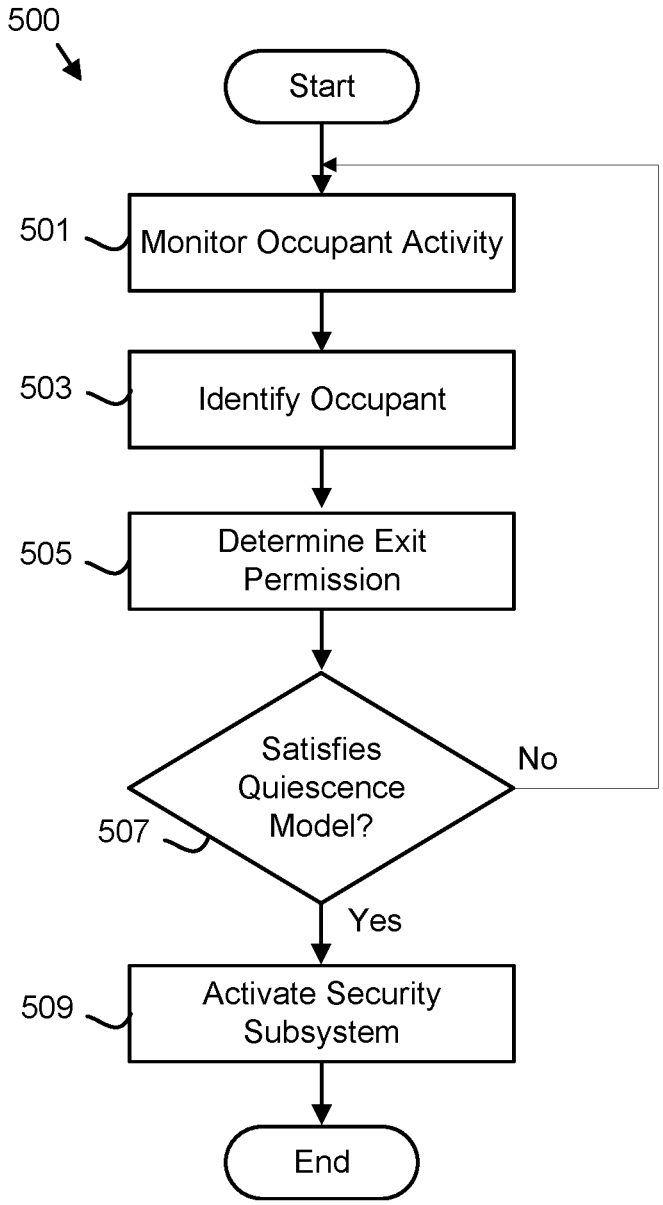
FIG. 5A is a schematic flow chart diagram illustrating one embodiment of a security subsystem activation method.

FIG. 5A is a schematic flow chart diagram illustrating one embodiment of a security subsystem activation method 500. The method 500 may automatically activate the security subsystem 120. The method 500 may be performed by the processor 405 of the computer 400 and/or the neural network 475.

The method 500 starts, and in one embodiment, the processor 405 monitors 501 the occupant activity from the plurality of electronic devices 110. The occupant activity may be stored as occupant activity data 201. In one embodiment, the processor 405 queries an electronic device 110 for the occupant activity data 201. In addition, an electronic device 110 may report the occupant activity data 201 to the processor 405.

The processor 405 may identify 503 the occupant of the occupant activity. In one embodiment, the occupant is identified 503 based on the electronic device 110. For example, if the occupant activity data 201 is from an electronic device 110 of a first occupant, the occupant activity data 201 may be associated with the first occupant.

In one embodiment, the occupant is identified 503 by comparing the occupant identity data 203 to the occupant activity data 201. For example, the occupant may be identified 503 by matching an image of the occupant to a video stream from an electronic device 110.

The processor 405 may determine 505 the occupant has exit permission. In one embodiment, the processor 405 compares the identity of the occupant to the stored exit permissions 205 to determine 505 whether the occupant has exit permission.

The processor 405 determines 507 the occupant activity satisfies the quiescence model 221. In one embodiment, the occupant activity satisfies the quiescence model in response to one or more of a determination that the occupant is asleep, a determination that the occupant is not dressed to exit, a determination that a quiescence motion pattern is satisfied, and a determination that lighting satisfies a quiescence level.

The processor 405 may determine that the occupant is asleep based on one or more of an eye status of the occupant, a last motion of the occupant, a location of the occupant, and a breathing status of the occupant. In one embodiment, the processor 405 may calculate a sleep score SS using Equation 1, wherein ES is a length of time the eye status is closed, LM is elapsed time from the last motion, BD is true if the occupant is in bed, BS is true if the occupant's breathing status indicates sleep, and k1-4 are nonzero constants.

$$SS=k1*ES+k2*LM+k3*BD+k4*BS \quad \text{Equation 1}$$

In one embodiment, the processor 405 determines that the occupant is not dressed to exit if the occupants current attire does not match the dress data 213. In addition, the processor 405 may determine that the quiescence motion pattern is satisfied if the elapsed time from the last motion of the occupant is less than a last motion threshold of the threshold data 209.

In one embodiment, the processor 405 determines that the lighting of the space satisfies the quiescence level if the current lighting of the space is equivalent to the lighting data 215. In addition, the lighting of the space may be equivalent to the lighting data 215 if the lighting of the space is within one standard deviation of the average lighting data 215.

In one embodiment, the quiescence model 221 is the neural network 475. The neural network 475 may receive the occupant activity data 201 and determine whether the occupant activity satisfies the quiescence model 221. Because the neural network 475 is trained on the occupant activity data 201 combined with the exit data 207, the neural network 475 and quiescence model 221 embodied therein makes judgments on whether the quiescence model 221 is satisfied that cannot be reproduced by human judgment. As a result, the neural network 475 improves the functioning of the computer 400 beyond the abilities of an algorithm that may be processed by a human.

If the quiescence model 221 is not satisfied, the processor 405 continues to monitor 501 the occupant activity. If the quiescence model 221 is satisfied, the processor 405 activates 509 the security subsystem 120 and the method 500 ends. The method 500 determines when subsequent exits of the space are unlikely and automatically activates 509 the security subsystem 120.

Figure 5B:
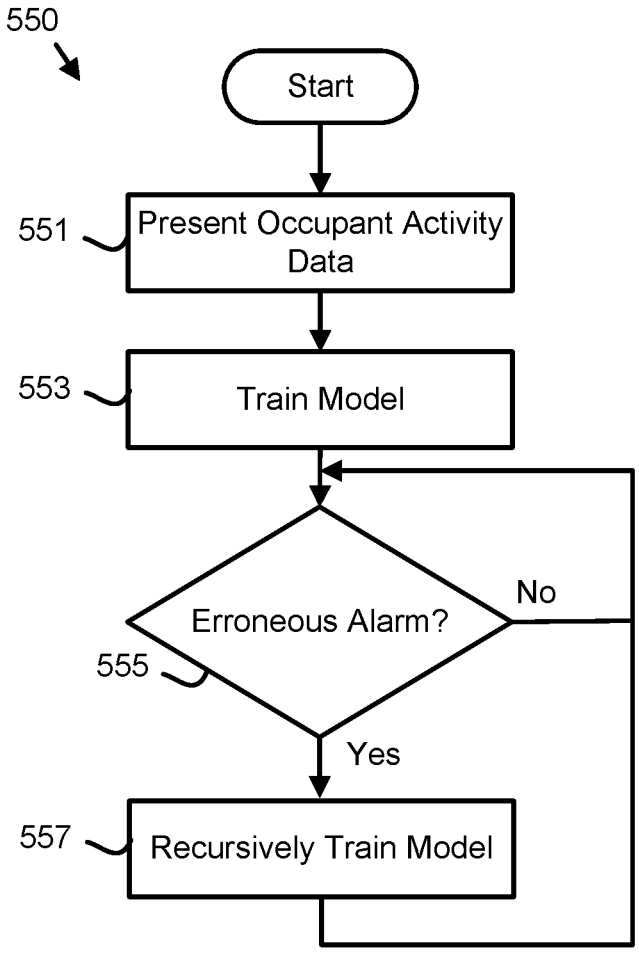
FIG. 5B is a schematic flowchart diagram illustrating one embodiment of a model training method.

FIG. 5B is a schematic flowchart diagram illustrating one embodiment of a model training method 550. The method 550 may train a model such as the quiescence model 221, the exit model 223, and/or the away tie model 225. The method 550 may be performed by the processor 405 and/or neural network 475.

The method 550 starts, and in one embodiment, the processor 405 presents 551 historical occupant activity data 201 from the plurality of electronic devices 110 to the neural network 475. In addition, the processor 405 may present 551 a result associated with the historical occupant activity data 201 such as the exit data 207 and/or the location data 211.

The processor 405 may further train 553 the model using the occupant activity data 201. The training may be supervised by providing results associated with the occupant activity data 201. Alternatively, the training may be unsupervised. The processor 405 may apply a learning method to the hidden neurons 455 of the neural network 475 to trained 553 the model. The learning method may set coefficients of the hidden neurons 455 to values that govern the function of the hidden neurons 455. The setting of the coefficients may be beyond human computational abilities. In one embodiment, the model is retrained 553 using each day's occupant activity data 201 with more recent occupant activity data 201 weighted more heavily.

The processor 405 may determine 555 if an erroneous alarm is received from the security subsystem 120. The erroneous alarm may be an alarm triggered by an occupant of the space. If no erroneous alarm occurs, the processor 405 may continue to determine 555 if erroneous alarm is received. If the erroneous alarm is determined 555, the processor 405 may recursively train 557 the model with additional weighting on the occupant activity that caused the erroneous alarm.

Figure 5C:
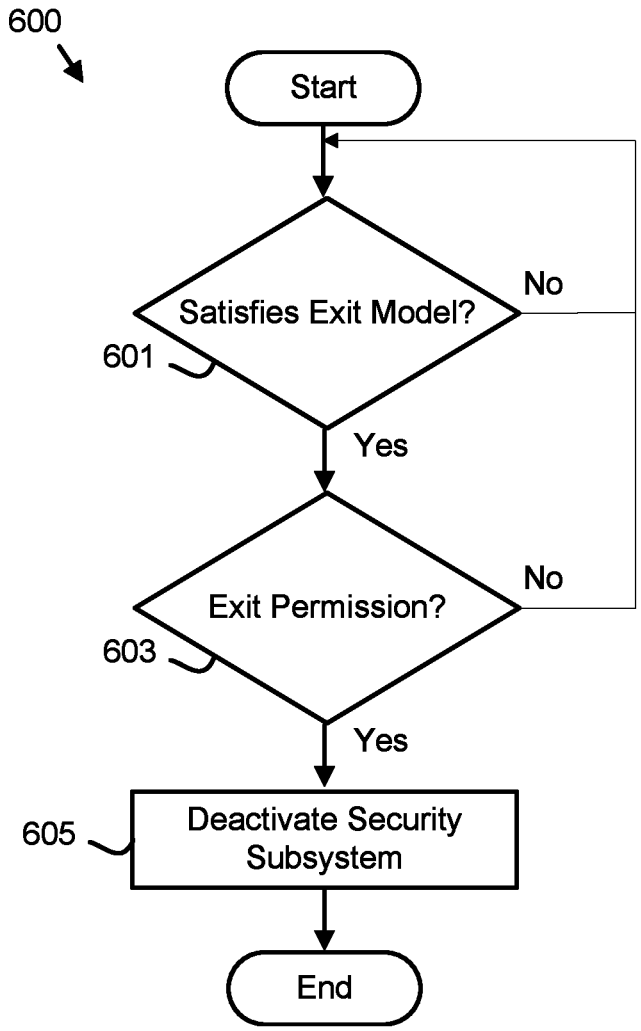
FIG. 5C is a schematic flow chart diagram illustrating one embodiment of a security subsystem deactivation method.

FIG. 5C is a schematic flow chart diagram illustrating one embodiment of a security subsystem deactivation method 600. The method 600 may automatically deactivate the security subsystem 120. The method 600 may be performed by the processor 405 and/or the neural network 475.

The method 600 starts, and in one embodiment, the processor 405 determines 601 the occupant activity satisfies the exit model 223. In a certain embodiment, the exit model 223 is satisfied if the current dress of the occupant conforms to the dress data 213 and the location of the occupant is within a proximity threshold of the proximity data 209 of an exit. If the occupant activity does not satisfy the exit model 223, the processor 405 continues to determine 601 whether the occupant activity satisfies the exit model 223.

If the occupant activity satisfies the exit model 223 the processor 405 determines 603 if the occupant has exit permission. In one embodiment, the processor 405 identifies the occupant and retrieves the occupant's exit permissions 205 to determine if the occupant has exit permission. If the occupant does not have exit permission, the processor 405 continues to determine 601 whether the occupant activity satisfies the exit model 223.

In response to the occupant activity satisfying the exit model 223 and the occupant having exit permission, the processor 405 may deactivate 605 the security subsystem 120 and the method 600 ends. The method 600 allows the activation system 100 to detect an occupant that is about to exit the space and deactivate 605 the security subsystem 120 if the occupant has exit permission.

In one embodiment, the exit model 223 is the neural network 475. The neural network 475 may receive the occupant activity data 201 and determine whether the occupant activity satisfies the exit model 223. Because the neural network 475 is trained on the occupant activity data 201 combined with the exit data 207, the neural network 475 and exit model 223 embodied therein makes judgments on whether the exit model 223 is satisfied that cannot be reproduced by human judgment. As a result, the neural network 475 improves the functioning of the computer 400 beyond the abilities of an algorithm that may be processed by a human.

Figure 5D:
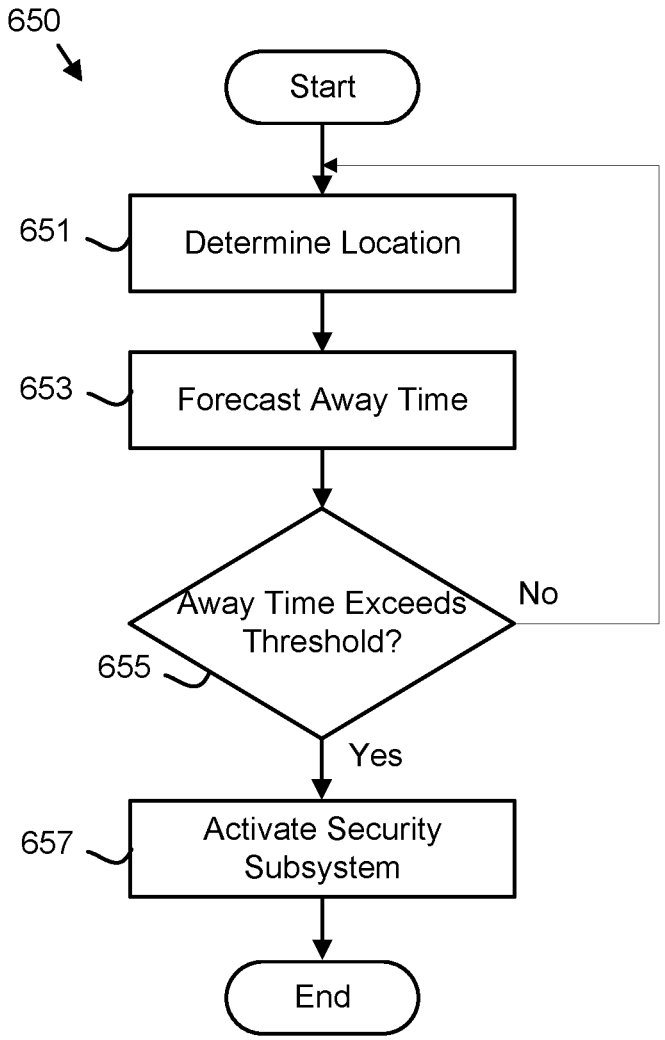
FIG. 5D is a schematic flow chart diagram illustrating one embodiment of a location-based security subsystem activation method.

FIG. 5D is a schematic flow chart diagram illustrating one embodiment of a location-based security subsystem activation method 650. The method 650 may automatically activate the security subsystem 120 when the occupants of the space are likely to be away from the space for an extended period. The method 650 may be performed by the processor 405 and/or the neural network 475.

The method 650 starts, and in one embodiment, the processor 405 determines 651 the location of each occupant of the space. The location of each occupant may be determined 651 from the location of an electronic device 110 associated with each occupant. Alternatively, the location of each occupant may be determined 651 from an image of each occupant captured by an electronic device 110. In one embodiment, the location of an occupant is determined 651 to be outside a boundary of the space.

The processor 405 may forecast 653 the away time wherein all occupants of the space are outside the boundary of the space using the away time model 225. The away time model 225 may be the neural network 475. The away time model 225 may forecast the away time based on the occupant activity data 201 based on criteria that cannot be reproduced by human judgment. As a result, the neural network 475 improves the functioning of the computer 400 beyond the abilities of an algorithm that may be processed by a human.

The processor 405 may determine 655 if the away time exceeds an away time threshold of the threshold data 209. If the away time does not exceed the away time threshold, the processor 405 continues to determine 651 the locations of the occupants. If the away time exceeds the away time threshold, the processor 405 may activate 657 the security subsystem 120. As a result, if the occupants do not activate the security subsystem 120 when leaving for the day, the activation system 100 automatically activates 657 the security subsystem 120.

The embodiments determine that the occupant activity satisfies the quiescence model 221 and automatically activate the security subsystem 120. As a result, if the occupants retire for the evening without activating the security subsystem 120, the embodiments automatically activate the security subsystem 120 to increase the protection for the space and its occupants. In addition, the embodiments may automatically deactivate the security subsystem 120 in response to the exit model 223 being satisfied for an occupant and the occupant having exit permission. As a result, an occupant that decides to exit the space will not inadvertently trigger the security subsystem 120.

The embodiments may further determine that the occupants of the space are away for at least an away time threshold and automatically activate security subsystem 120. As a result, even if the occupants forget to activate the security subsystem 120 when leaving for the day, the security subsystem 120 is automatically activated, protecting the space. Thus the embodiments improve the functioning of the security subsystem 120.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a security subsystem;

a processor;

a memory that stores code executable by the processor to:

monitor occupant activity from a plurality of electronic devices;

identify the occupant of the occupant activity;

determine the occupant activity satisfies a quiescence model;

activate the security subsystem in response to satisfying the quiescence model;

determine the occupant activity satisfies an exit model in response to current dress of the occupant conforming to dress data and a location of the occupant being within a proximity threshold of an exit;

determine the occupant has an exit permission for the occupant for a current time, wherein the exit permission specifies a time that the occupant is permitted to exit without activating the security subsystem and the exit permission is based on whether the occupant is an adult or a teenager; and deactivate the security subsystem in response to both satisfying the exit model and the occupant having exit permission.

2. The apparatus of claim 1, wherein the exit model is a neural network recursively trained from a plurality of occupant activity data and exit data.

3. The apparatus of claim 1, wherein the quiescence model is a neural network recursively trained from a plurality of occupant activity data and a last exit.

4. The apparatus of claim 1, wherein the occupant activity satisfies the quiescence model in response to one or more of a determination that the occupant is asleep, a determination that the occupant is not dressed to exit, a determination that a quiescence motion pattern is satisfied, and a determination that lighting satisfies a quiescence level.

5. The apparatus of claim 1, wherein the code is further executable by the processor to:

determine a location of each occupant;

forecast an away time for each occupant from an away time model based on the location; and activate the security subsystem in response to the away time for each occupant exceeding an away time threshold.

6. A method comprising:

monitoring, by use of a processor, occupant activity from a plurality of electronic devices;

identifying the occupant of the occupant activity;

determining the occupant activity satisfies a quiescence model;

activating a security subsystem in response to satisfying the quiescence model;

determining the occupant activity satisfies an exit model in response to current dress of the occupant conforming to dress data and a location of the occupant being within a proximity threshold of an exit;

determining the occupant has an exit permission for the occupant for a current time, wherein the exit permission specifies a time that the occupant is permitted to exit without activating the security subsystem and the exit permission is based on whether the occupant is an adult or a teenager; and deactivating the security subsystem in response to both satisfying the exit model and the occupant having exit permission.

7. The method of claim 6, wherein the exit model is a neural network recursively trained from a plurality of occupant activity data and exit data.

8. The method of claim 6, wherein the quiescence model is a neural network recursively trained from a plurality of occupant activity data and a last exit.

9. The method of claim 6, wherein the occupant activity satisfies the quiescence model in response to one or more of a determination that the occupant is asleep, a determination that the occupant is not dressed to exit, a determination that a quiescence motion pattern is satisfied, and a determination that lighting satisfies a quiescence level.

10. The method of claim 6, the method further comprising:

determining a location of each occupant;

forecasting an away time for each occupant from an away time model based on the location; and activating the security subsystem in response to the away time for each occupant exceeding an away time threshold.

11. A program product comprising a non-transitory computer readable storage medium that stores code executable by a processor, the executable code comprising code to:

monitor occupant activity from a plurality of electronic devices;

identify the occupant of the occupant activity;

determine the occupant activity satisfies a quiescence model;

activate the security subsystem in response to satisfying the quiescence model;

determine the occupant activity satisfies an exit model in response to current dress of the occupant conforming to dress data and a location of the occupant being within a proximity threshold of an exit;

determine the occupant has an exit permission for the occupant for a current time, wherein the exit permission specifies a time that the occupant is permitted to exit without activating the security subsystem and the exit permission is based on whether the occupant is an adult or a teenager; and deactivate the security subsystem in response to both satisfying the exit model and the occupant having exit permission.

12. The program product of claim 11, wherein the exit model is a neural network recursively trained from a plurality of occupant activity data and exit data.

13. The program product of claim 11, wherein the quiescence model is a neural network recursively trained from a plurality of occupant activity data and a last exit.

14. The program product of claim 11, wherein the occupant activity satisfies the quiescence model in response to one or more of a determination that the occupant is asleep, a determination that the occupant is not dressed to exit, a determination that a quiescence motion pattern is satisfied, and a determination that lighting satisfies a quiescence level.

* * * * *